US005133108A

United States Patent [19]

Esnault

[11] Patent Number: 5,133,108

[45] Date of Patent: Jul. 28, 1992

[54] PANEL ARTICULATION SYSTEM

[75] Inventor: Paul Esnault, Montardon, France

[73] Assignee: FTFM la Toulousaine, Toulouse, France

[21] Appl. No.: 716,647

[22] Filed: Jun. 17, 1991

[30] Foreign Application Priority Data

Jun. 26, 1990 [FR] France ..... 90 08426

[51] Int. Cl.[5] ..... E05D 1/00

[52] U.S. Cl. ..... 16/225; 16/355; 16/DIG. 13

[58] Field of Search ..... 16/225, DIG. 13, 355, 16/356; 160/231.2

[56] References Cited

U.S. PATENT DOCUMENTS 2,952,313 9/1960 Stroup ..... 16/355
3,234,996 2/1966 King et al. ..... 160/231.2
3,326,268 6/1967 Dixon ..... 16/225
3,527,283 9/1970 Butler et al. ..... 16/DIG. 13

*Primary Examiner*—Robert L. Spruill
*Assistant Examiner*—Carmine Cuda
*Attorney, Agent, or Firm*—Harold H. Dutton, Jr.

[57] ABSTRACT

An articulation system for two panels, comprising a flexible hinge (4) and edge sections (1, 2; 3) for the panels, for receiving and retaining the flexible hinge, a flexible hinge (4) having a central tubular portion (13) arranged in the vicinity of the median plane of the panels is provided and includes two flanges (14, 15) adapted to snap lock into the edge sections; the latter comprise channels (L1, L2) permitting this snap locking engagement, and guide surfaces (S, Sc; Sax, Sac, AL) are arranged on respective parts about the median plane of the panels, for guiding their pivotal movement about an axis of rotation passing through the central tubular portion of the flexible hinge. The invention may in particular be used with sectional doors.

20 Claims, 4 Drawing Sheets

P2
X'
3
6
17
M2
B2
M4
Sc
L2
8
M3
M1
Sac
A2
Sx
12
15a
15
AL
1
B1
13
4
Sax
7
14
2a
14a
fi
11b
A1
L1
2
2b
11a
Ae
1a
9
1b
2c
1c
10
5
P1
R
z'
16
X 3
15a
4
L1
14a
1

L1
1

2

2c
1c
1

2b
2a
1a
1b
1

PANEL ARTICULATION SYSTEM

This invention relates to an articulation system for panels, and in particular, the application thereof for use on sectional doors.

BACKGROUND AND OBJECTS OF THE INVENTION

Sectional doors (such as garage doors, factory doors, warehouse doors, and other similar closures) are generally comprised of a plurality of panels extending horizontally, which are articulated together so as to be able to slide vertically and fold at the top of the opening in order to then extend horizontally in the upper part of the building.

Conventional articulation systems for these sectional doors are formed of rigid hinges secured from place to place on one side of the door such as the frontside for connecting pairs of panels. However, these systems have serious drawbacks: there are disadvantages with the seals at the joints between panels, long and unappealing appearance of the hinges, some danger for users (in particular the danger of pinching fingers between the panels during closing).

Some systems with flexible hinges are known, in which a sheet of flexible material is fixed along the stops of the edges of two panels in such a manner that they are connected by a flexible thickness, enabling the articulation because of the deformation of the flexible strip (French patent 2,421,332, U.S. Pat. No. 3,527,283). Such systems lead to an improved seal, but nonetheless still have significant drawbacks in that they are fragile, of short life and do not achieve a very precise positioning of the panels. In particular, during articulation play, all forces are concentrated at the point of a relatively thin, flexible strip in order to permit a good closing of the panels. This thickness is sometimes deformed in an unsymmetrical manner in the case of poorly balanced loads and causes a premature aging. These drawbacks in practice prevent the use of such systems with flexible hinges for sectional doors since, by reason of their dimensions, such doors may be subjected to great loads. Further, these systems do not prevent the danger of pinching fingers between panels.

The present invention seeks to provide a new articulation system of the type comprising on one hand a hinge in the nature of a flexible profile or strip arranged between panels along the length thereof, and on the other hand cooperating panel edge sections for maintaining the flexible hinge.

An object of the invention is to provide a system which combines excellent qualities of sealing with a great sturdiness permitting in practice the application of the invention to sectional doors.

Another object of the invention is to assure a precise positioning of the panels with respect to each other, a precision positioning which is comparable to that of rigid hinges.

Another object is to reduce considerably the risks for users, in particular the risk of pinching fingers between panels.

DESCRIPTION OF THE INVENTION

To this end, the articulation system according to the invention is characterized in that:

(a) the flexible hinge comprises a central tubular section in the vicinity of the median plane of the panels and two flanges joined to the central section at opposite points of said central section and provided with interlocking heads;

(b) the edge sections of the panels comprise:

channels opening on the edge in the vicinity of the median plane of the panels and having shapes adapted to receive and hold the locking heads of the hinge flanges, rotational guide surfaces, arranged on opposite sides of the median plane of the panels such that the guide surfaces of one edge section come into opposition with the guide surfaces of the other edge section for guiding the pivoting of the panels about an axis of rotation passing through the central tubular section of the flexible hinge or close to it.

The flexible hinge may be produced of an elastomeric material, and its central tubular section may be solid or hollow. Closure plugs may, in the case of a hollow tubular section, be arranged at the two ends for sealing the air in the central section and combining a pneumatic effect with the elasticity of the material.

The articulation system according to the invention which extends all along the panels, forms a very effective barrier seal which resists any infiltration. Such a system is very sturdy because deformation of the flexible hinge is carried out at the point of a tubular section which gives rise essentially to constraints of compression or tension (and not flexure forces as is the case in known flexible hinges). Further, these constraints are limited by the rotational guide surfaces, which reduce the extent of the deformation of the flexible hinge. In addition, the structure described above of said hinge and the presence of these guide surfaces assure a precise positioning of the panels over the entire angular range of pivoting. As will be better understood below, the system according to the invention benefits from a rapid assembly and mounting, and is carried out by a simple snap fit engagement.

It should be noted that the pivoting of one panel with respect to another is carried out about a point adjacent to the median plane of the panels. In numerous applications, and especially when applied to sectional doors, this arrangement simplifies the concept of the guide means and operation of the panels, and permits a better balancing of the moving masses.

According to another characteristic of the invention, the edge sections comprise advantageously tension retaining surfaces, arranged such that the retaining surfaces of one edge section come into cooperating relationship with retaining surfaces of the other edge section for supporting the forces tending to separate the adjacent panels. In such a manner, any forces which are exerted on the flexible hinge are limited, regardless of the loads applied to the system.

According to a preferred embodiment, one of the edge sections comprises two interlocking sections engageable with each other: on one hand, a primary section forming an incomplete channel for the interlocking head of the flexible hinge, and on the other hand a clip adapted to interlock with this primary section and comprising a locking finger for completing said channel.

Such a shape facilitates the mounting of the system, while providing simplified, easily extruded structural sections.

In particular, the clip mentioned above is adapted to snap into the primary section along three clip-together zones: a central zone situated on the side of the aforementioned channel, an intermediate zone and an end zone situated at the end of one wing flange of the clip for the opposite side of the locking finger. A good rigidity of the clip is thus obtained on the primary section.

The invention also extends as well to new products, that is edge sections and flexible hinge sections, which sections are adapted to permit the production of the articulation system described.

The articulation system according to the invention may be applied for articulating in pairs, two sectional door panels, in order to obtain sealed, sturdy, well balanced doors, which benefit from reliable operation.

BRIEF DESCRIPTION OF THE DRAWINGS

Other characteristics, objects and advantages of the invention will become apparent from the description which follows, in reference to the accompanying drawings which show by way of non-limiting example, one embodiment of the invention. In these drawings, which form an integral part of the present description.

DETAILED DESCRIPTION OF PREFERRED EMBODIMENTS

Figure 1:
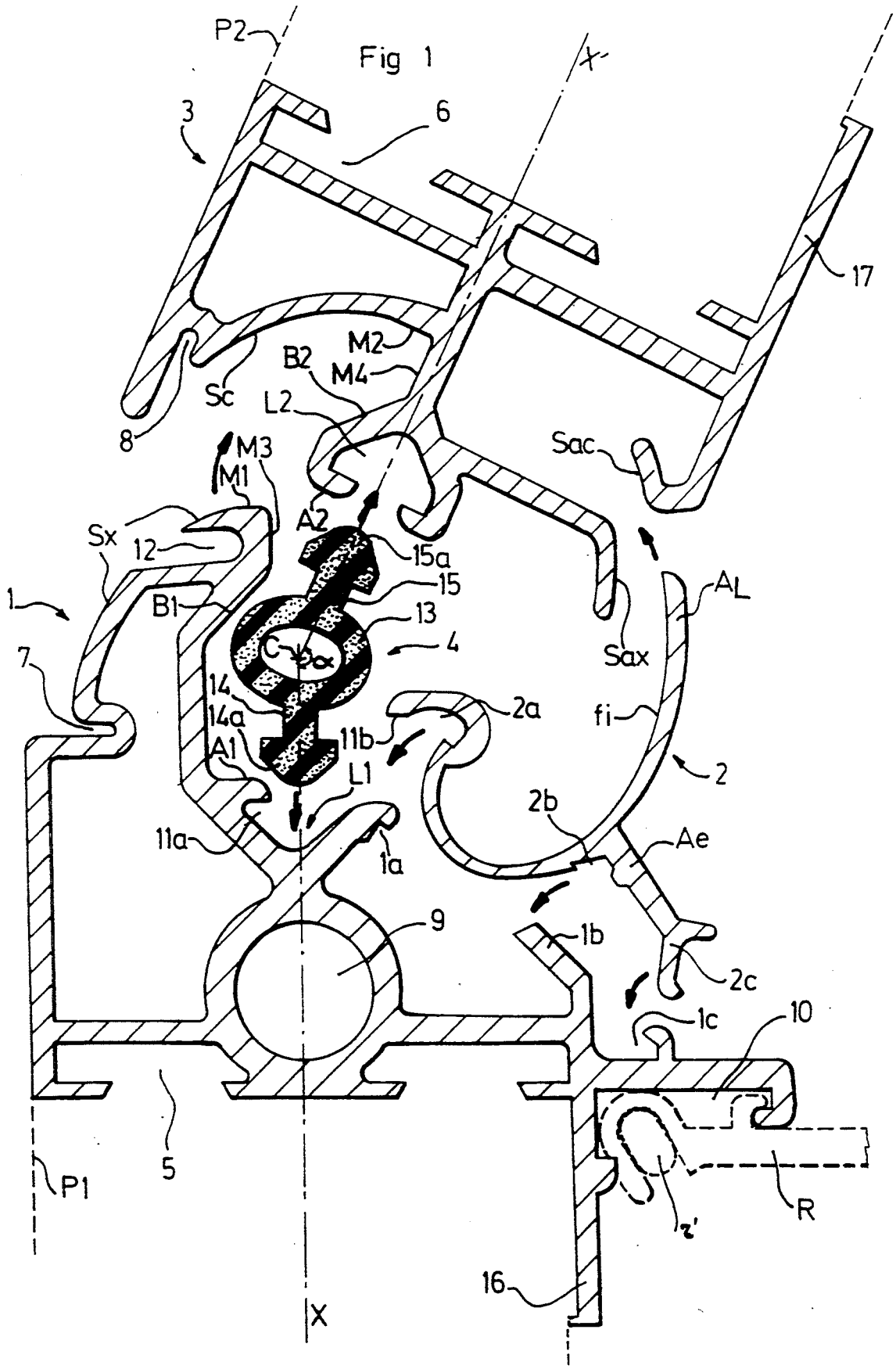
FIG. 1 is a transverse cross-section of the elements constituting the articulation system according to the invention, in a disassembled state.

The articulation system shown in a disassembled state in FIG. 1 comprises essentially a first edge section formed of two profiles interlockable one with the other (a primary profile 1 and a clip 2), a second edge section 3, and a flexible hinge section 4.

The profiles 1 and 2, as well as the section 3, are made of a lightweight extruded alloy of aluminum, while the flexible section 4 is made of an elastomeric material. For the purposes of this description, the terms "profile" and "section" are used to designate the same elements.

These profiles are called upon to extend along the entire length of the two panels indicated by P1 and P2 in FIG. 1, the section 1 being secured to the edge of one of the panels and the section 3 secured to the edge of the other panel. To assure this attachment, the sections 1 and 3 comprise firstly structures such as 5 or 6 adapted to clip onto, for example, a mullion of a glazed window. In addition, each of these sections is provided with a channel 7 or 8 for insertion of the edge of a sheet which is to form the front face of the panel, and a wing 16 or 17 for holding the edge of a sheet which is to form the rear face of the panel. In the example, the channel 7 of the profile 1 extends along a horizontal plane, the sheet coming to be inserted after folding to 90°, and the channel 8 of the profile 2 extends along a vertical plane, the sheet coming to be inserted after folding back at 180° (the terms "horizontal" and "vertical" refer to a position of the panels in a vertical plane, their edge extending horizontally). The profiles 1 and 3 are thus used universally useable and capable of being secured to the edges of panels of different types.

In the application shown (a system for sectional doors), at least one of the profiles 1 or 3 (in the example, the profile 1) is provided, in its axial plane X, with a circular opening 9 for lateral placement of the axes of live friction rollers. Further, at least one of the edge profiles (in the example, section 1) comprises, on one side, interlock structures 10 for an inertial reinforcement (shown schematically at R in FIG. 1).

The sections 1, 2 and the profile 3 form grooves L1, L2 opening toward the edge in the vicinity of the median planes X and X' for the interlock of the flexible hinge section 4.

These grooves are of a generally triangular shape as seen in FIG. 1.

The groove L2 is entirely defined by the section 3, while the section 1 defines an incomplete channel **11*a* which is missing one of the lateral returns. This groove is completed to provide the groove L1 by a locking finger 11*b* carried by the clip 2**.

The sections 1 and 3 comprise further, rotational guiding surfaces comprising:

on one side of the median planes X, X', a convex surface Sx situated on the profile 1 and a conjugate concave surface Sv situated on the section 3, these surfaces Sx and Sv coming into face to face relationship when the system is assembled, on the other side of the median planes X, X', a circular wing AL forming part of the clip 2 and two conjugate curved surfaces, a concave surface Sac and a convex surface Sax, arranged on the section 3, in such a manner that the wing AL is engaged with and enters between these surfaces when the system is mounted and caused to pivot.

The surfaces Sx and Sv have circular sections centered, when the system is mounted, in proximity to the center C of the flexible hinge, in such a manner as to guide the pivoting of the panels about an axis of rotation passing essentially through this center. This is the same with the circular wing AL and the conjugate surfaces Sax and Sac which are centered proximate the center of the hinge.

The convex surface Sx of section 1 is interrupted by a groove 12 adapted to form a water receiver preventing the entry of water therealong by capillary action.

At the ends near the median planes X, X' of the surfaces Sx and Sc, the sections 1 and 3 comprise rest surfaces, formed by flats M1 and M2 essentially orthogonal to the median planes, which permits the sections to rest against each other in a position of alignment of the panels. These flats situated in the immediate vicinity of the median planes assure in this position of alignment a balanced transmission of loads of compression between panels, avoiding an excessive crushing of the flexible hinge. They are completed by the positioning flats M3 and M4 parallel to the median planes and which come into face to face contact when the panels arrive in the position of alignment, thusly defining this position in a precise manner.

The sections 1, 2 and 3 also comprise tension retention surfaces which resist any pulling apart of the panels, which surfaces are arranged to take up any such pulling forces between panels. These retention surfaces are of two types:

first surfaces B1, B2 arranged on the sections 1 and 3 in such a manner as to come into cooperative relationship and resist the separating forces when the panels are substantially in alignment, and second surfaces which, in the example, coincide with the guide surface Sax and the internal face fi of the guide wing AL, and are arranged to come into face to face contact and resist separating forces exerted on the panels when the panels form an angle between them.

The first retention surfaces B1, B2 are constituted by oblique flats (in particular at an angle of 45° to the median planes) which come to cooperate when the sections arrive in an aligned position and a separating force is exerted thereon. This arrangement prevents the flexible hinge from being subjected to excessive pulling forces, while guarantying a freedom of rotation of articulation even under high pulling force.

It will be noted that the wing AL of the clip 2 is provided such that its internal face fi comes face to face with the surface Sax from the alignment position, such that the first and second retention surfaces have a common angular working range. This then avoids, for certain angles, that the pulling forces would be absorbed and transferred to the flexible hinge.

The clip 2 which carries the prong 11*b* of the interlock of the channel L1 has the essential function of permitting an easy mounting of the system. It is adapted to be interlocked on the primary section 1 by three interlock zones:

a so-called central zone situated on the side of the groove L1 in the vicinity of the median plane X, the clip being provided in this zone with a locking structure 2*a* intended to cooperate with a cooperating structure 1*a* formed on the section 1;

an intermediate zone situated at the base of the circular wing AL, the clip being provided in this zone with a locking structure 2*b* intended to cooperate with a conjugate flange 1*b* formed on the section 1;

an extreme or end zone situated at the end of a flange Ae formed on the clip opposite the flange 11*b*, this flange carrying a locking structure 2*c* is intended to cooperate with a conjugate structure 1*c* on the section 1.

These arrangements assure a secure fastening of the clip 2 on the section 1, while enabling a great ease of installation or removal by an operator. It should be noted that, between the flange 11*b* and the interlock zone 2*b*, the clip 2 has a convex shape which is provided to form a supplementary rest point while coming into contact against the external wall of the bore 9 of the section 1.

The flexible hinge 4 is formed by a central, hollow tubular portion 13 and by two wings 14 and 15 which are attached opposite each other to the tubular portion and are provided with locking heads 14*a* and 15*a*.

When the system is in the normal, erected position, the central portion pushes against the sections 1, 2 and 3 in opposite directions while coming to rest against rest surfaces such as A1 and A2 which these sections include in the vicinity of the grooves L1 and L2, on each side of the opening of the latter. The elastic effect of the tubular portion 13 (due to its shape and the nature of the material from which it is made) can, if need be, be reinforced with a pneumatic effect by closing each of the ends of the tubular portion in a sealed manner.

The wings 14 and 15 of the flexible hinge 4 are formed on the tubular section in such a manner as to form between them, when at rest, an angle of between about 140° and 160°, preferably on the order of about 150° as shown in FIG. 1. The flexible hinge is thus apt to undergo, starting from this rest position, opposed deformations when the panels pivot toward their position of alignment or toward their extreme angular position. While thus reducing the amplitude of deformations which it must undergo, the hinge is caused to work under better conditions and its life is increased.

The interlocking heads 14*a* and 15*a* are of a shape which is generally triangular, and is adapted to enter into the channels because of their elasticity and to be retained therein without risk of release when the system is erected.

To this end, each head comprises, at its base, two shoulders which are retained by the front return members of the channel L1 or L2 as well as the slanted front faces which permit the passage of the head into the opening of the channel during erection.

Figure 2:
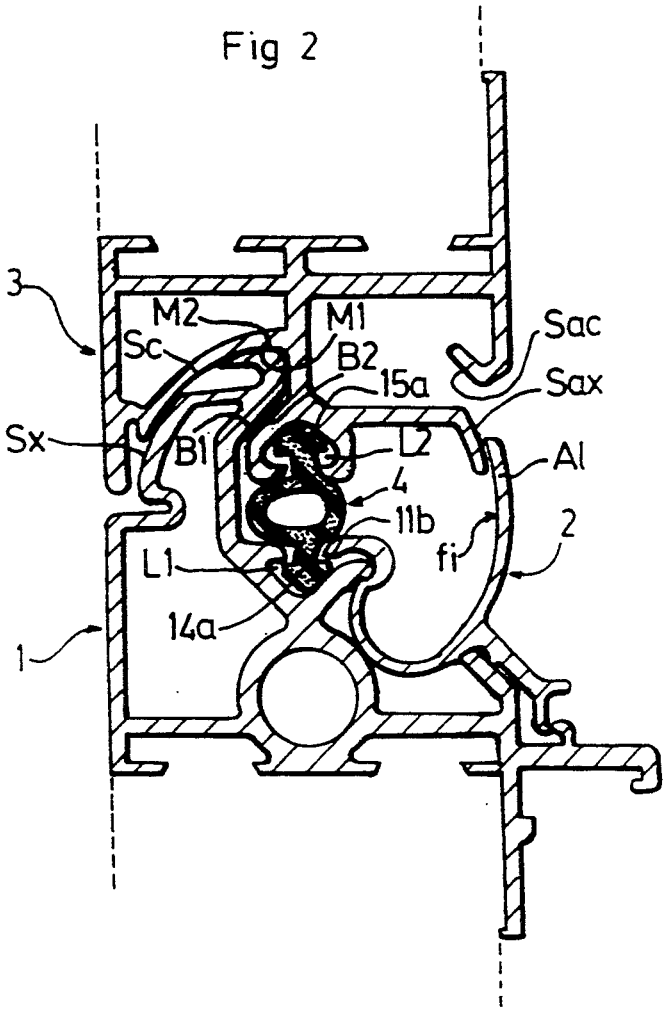
FIGS. 2, 3 and 4 are transverse cross-sectional views showing this system mounted in three positions corresponding respectively to the position of alignment of the panels, an intermediate pivoted position, and the position of maximum pivoting.
Figure 3:
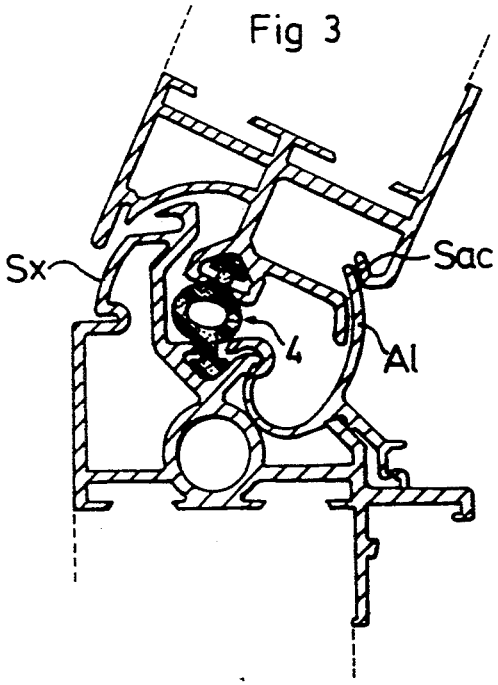
Figure 4:
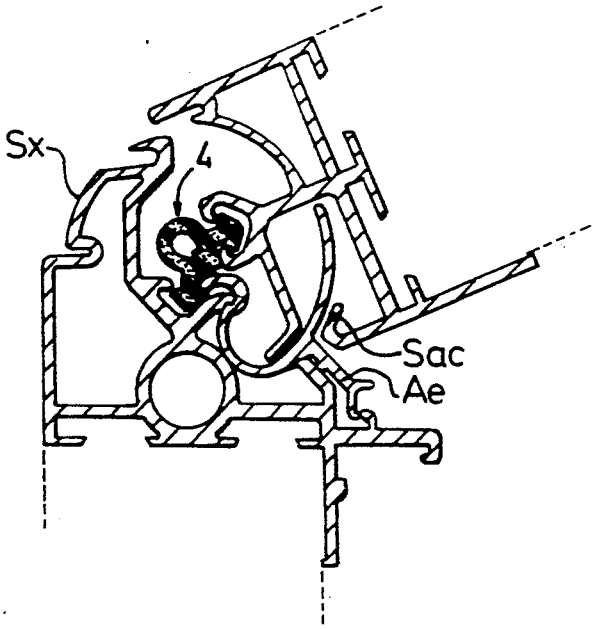

FIGS. 2, 3 and 4 show the system according to the invention respectively in the position corresponding to alignment of the panels (FIG. 2), in an intermediate pivoting position corresponding to the state of rest of the flexible hinge 4 (FIG. 3), and in the extreme pivot position (FIG. 4).

In the position of alignment of the panels, the profiles 1, 2 and 3 have a generally rectangular shape, the central tubular section 13 of the flexible hinge being situated at the center of the rectangle, when the assembly is mounted (interlocking heads 14*a* and 15*a* in place in their channels L1 or L2, channel L1 closed by the locking finger 11*b* of the clip). When the panels are under compression, one against the other, the flats M1 and M2 of the sections 1 and 2 constitute supports and support the essential part of the load. The panels are positioned in a precise manner, one with respect to the other, by all of the cooperating surfaces capable of coming into contact (guide surfaces Sc and Sx, guiding and retaining surfaces fi and Sax, retaining surfaces B1 and B2).

When the panels pivot with respect to each other (FIG. 3), the wing AL of the clip comes face to face with the guide surface Sac which assures a complementary guiding.

At the end of the pivotal movement (FIG. 4), the extreme return part which supports the surface Sac, comes to rest against the wing AL of the clip, forming a stop preventing further travel. The hinge 4 is deformed in the opposite direction with respect to the alignment position.

Such a system combines significant qualities of sturdiness with a perfect seal regardless of the position, while the panels are always guided in a precise manner with respect to each other. Further, in the pivoting position, the convex surface Sx closes the angle of opening and reduces considerably the dangers to users (risk of pinching fingers or some foreign object).

FIGS. 5 through 10 show the process of assembling the system.

Figures 5, 6, 7, 8, 9, 10:
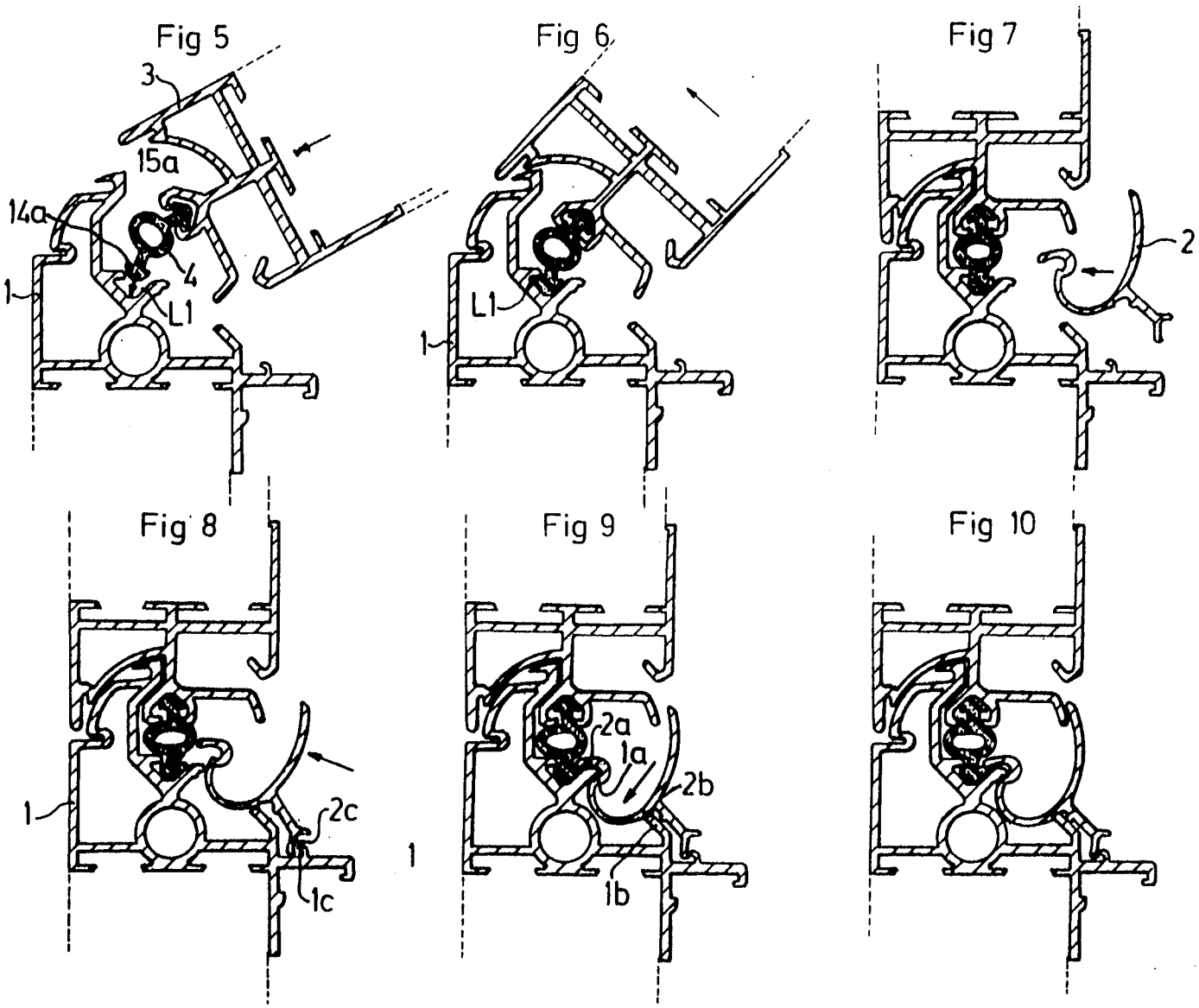
FIGS. 5, 6, 7, 8, 9 and 10 are schematic views of the mounting of the system.

The flexible hinge 4 is initially snapped into the section 3 because of the flexibility/elasticity of the interlock head 15*a*, and the panels are then brought together with respect to each other in an angular position such as shown in FIG. 5.

The interlock head 14*a* is inserted into the incomplete channel L1 of the section 1 (FIG. 6).

Next, the panels are straightened out to arrange them in an alignment position in order to snap the clip 2 into place. This is done as shown in FIG. 7, from the rear of sections 1 and 3. It is inserted into the free space with its interlocking structure 2*c* engaged with the cooperating structure 1*c* of the section 1. (FIG. 8).

The clip is then snapped into the section 1 by insertion of its interlocking portions 2a and 2b on the conjugate structures 1a and 1b of the section 1 (FIG. 9).

The assembled system is then ready to operate (FIGURE lo). The great simplicity of the assembly of the system is readily seen, eliminating the need for any drilling or bolting operation.

Figure 11:
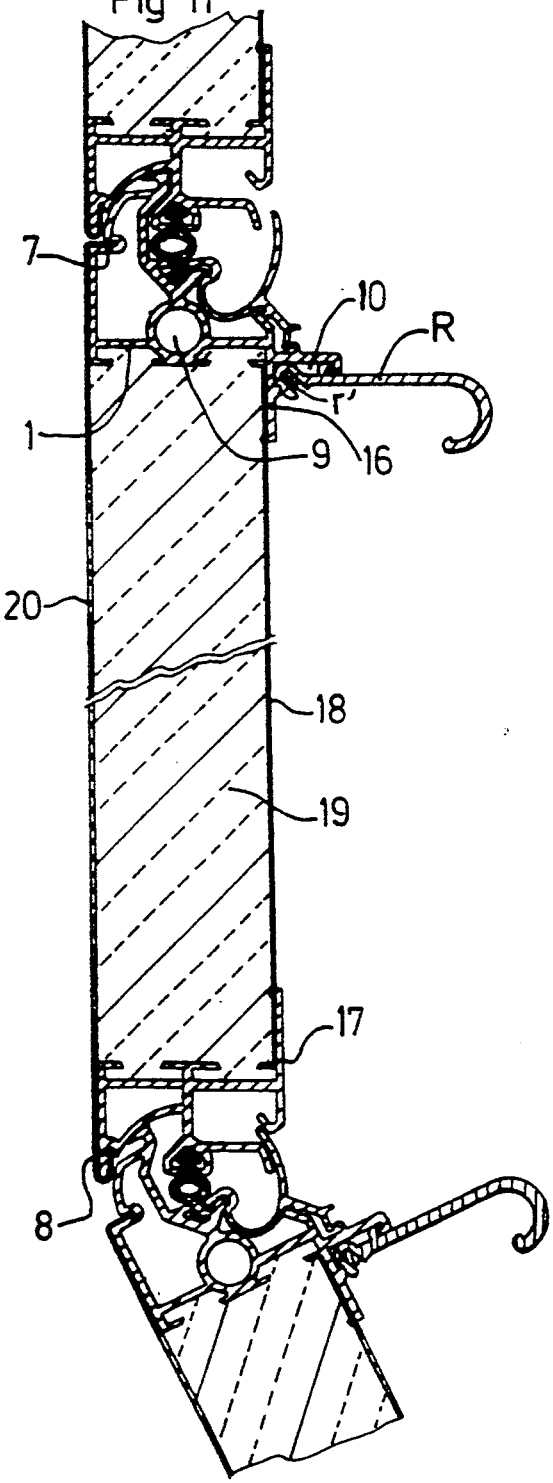
FIG. 11 is a partial transverse cross-sectional view of sectional door panels articulated by means of the present system.

FIG. 11 shows, in a partial cross-sectional view, a sectional door equipped with the articulation system according to this invention. The panels are articulated in pairs by means of these systems, with the insertion of the axles of bearing wheels into the bores 9 as the lateral edges. The position of these bearings wheels (in the median plane of each panel) greatly improves the balance of the sectional door (in comparison to known doors on which these bearing wheels are displaced with respect to the median plane of the panels by necessity).

In the example of FIGURE 11, each panel is formed by a rear sheet 18 resting against the holding flanges 16 and 17 of the sections of two adjacent systems, by a layer 19 of a filling material such as a polyurethane foam and by a front sheet 20, the edges of which are folded back by 90° or 180° to be inserted into the grooves 7 and 8 of the sections of the two adjacent systems. A stiffener R may also be snapped into the structure 10 which is provided for this purpose. This stiffener forms a gutter which is expanded in place by "pop" rivets r' in order to form a unit with the section.

Figure 12:
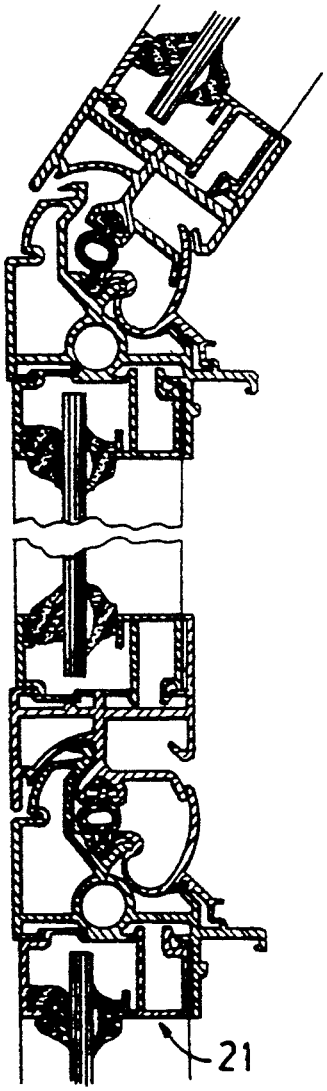
FIG. 12 is a schematic view of a panel equipped with a bay window.

FIG. 12 shows the embodiment of a bay window 21 equipped with the system. The bay is secured in a known manner to the articulation system via structures 5 and 6 provided for this purpose.

While this invention has been described as having certain preferred features and embodiments, it will be apparent that it is capable of still further variation and modification without departing from the spirit of the invention, and this application is intended to cover any and all variations, modifications and adaptations as may fall within the spirit of the invention and the scope of the appended claims.

I claim:

1. An articulation system for two panels comprising a flexible hinge arranged between said panels over the length thereof, and edge sections secured to the panels and so configured as to retain the flexible hinge, characterized in that:

(a) the flexible hinge (4) comprises a central tubular portion (13) positioned in the vicinity of the median plane (X, X') of the panels and two flanges (14, 15) attached at opposite sides of said tubular portion and having snap-locking heads (14a, 15a), (b) said panel edge sections (1, 2; 3) comprising:

channels (L1, L2) opening on the edge in the vicinity of the median plane of the panels and having shapes adapted to receive and retain said snap-locking heads (14a, 15a) of the flanges of the hinge, rotational guide surfaces (Sx, Sc; Sax, Sac, AL) arranged on either side of the median planes of the panels such that the guide surfaces of one edge section come into contact with the guide surfaces of the other edge section for guiding the pivoting of the panels about an axis of rotation passing through the central tubular portion (13) of the flexible hinge or in proximity thereto.

2. An articulation system as in claim 1, and wherein said edge sections comprise retention surfaces resisting pulling forces (B1, B2; Sax, fi) arranged in such a manner that the retaining surfaces of one edge section come into contact with the guide surfaces of the other edge section for resisting any forces tending to separate the panels.

3. An articulation system as in claim 2, and wherein said retention surfaces resisting pulling forces comprise:

first retention surfaces (B1, B2) arranged to come into contact and resist forces separating the panels when the panels are substantially in alignment with each other, and second retention surfaces (Sax, fi) arranged to come into contact and resist such separating forces when the panels form an angle with each other.

4. An articulation system as in claim 3, and wherein said first retention surfaces (B1, B2) and second retention surfaces (Sax, fi) are arranged to have a common angular working range starting from the alignment position.

5. An articulation system as in claim 3, and wherein said first retention surfaces (B1, B2) comprise oblique flats arranged on each of the edge sections (1, 2) so as to be cooperable when the sections come into an alignment position.

6. An articulation system as in claim 1, and wherein said central tubular portion (13) of the flexible hinge is made of an elastomer able to push back against said edge sections in opposite directions, said edge sections (1, 2) comprising rest surfaces (Al, A2) against said central portion, situated in the vicinity of the opening of the channels (L1, L2) retaining the interlocking heads of the flexible hinges.

7. An articulation system as in claim 1, and wherein the rotational guide surfaces comprise:

on one side of the median plane (X, X') of the panels, a convex surface (Sx) situated on one section (1) and a cooperating concave surface (Sc) situated on the other section (3), said surfaces having arcuate cross-sections centered in proximity to the center of the portion (13) of the flexible hinge, on the other side of the median plane of the panels, a circular flange (AL) equipping a section (2) and two circular concave and convex surfaces (Sax, Sac), arranged on the other section (3) in such a manner that the circular flange (AL) can engage and penetrate between the same, said flange and said curved surfaces being centered in proximity to the center of the tubular section (13) of the flexible hinge.

8. An articulation system as in claim 7, characterized in that the arcuate convex surface (Sx) is interrupted by a groove (12) adapted to prevent inflow of water by capillary action.

9. An articulation system as in claim 7, and wherein one of the edge sections comprises two interlocking members, a primary member (1) forming an incomplete channel for the interlocking head (14a) of the flexible hinge, and a clip (2) able to interlock with the primary member and comprising a finger (11b) for interlocking with said channel.

10. An articulation system as in claim 9, and wherein said clip (2) carries an arcuate flange for coming into engagement between the curved rotational guide surfaces (Sac, Sax).

11. An articulation system as in claim 9, and wherein said clip (2) is adapted to interlock with the primary member (1) at three interlock zones: a central zone (2a) situated on the side of said channel (L1), an intermediate zone (2*b*) situated at the base of said arcuate flange (AL), and an end zone (2*c*) situated at the end of a small flange (Ae) of the clip opposite said interlocking finger (11*b*).

12. An articulation system as in claim 9, and wherein said edge sections (1, 2, 3) are arranged such that, for the alignment position of the panels, the edge sections generally define a rectangular shape, the central tubular portion (13) of the flexible hinge being situated at the center of said rectangle when the interlocking heads (14*a*, 15*a*) of said hinge are in place in their channels (L1, L2).

13. An articulation system as in claim 1, and wherein said edge sections (1, 3) comprise, in the vicinity of the two median planes (X, X') of the panels, rest surfaces (M1, M2) which are substantially orthogonal to said median planes so as to permit said sections to rest against each other in an alignment position of the panels.

14. An articulation system as in claim 1, and wherein said central tubular portion (13) of the flexible hinge is a hollow tube capable of being provided with sealing plugs at the ends thereof.

15. An articulation system as in claim 1, and wherein said flanges (14, 15) of the flexible hinge are attached to opposite portions of the central tubular portion (13) in such a manner as to form between the flanges, at rest, an angle ($\alpha$) comprising between 140° and 160°, the hinge being adapted to undergo, starting from this rest position, opposite deflections as the panels pivot toward their position of alignment or toward their extreme angular position.

16. An articulation system as in claim 1, for forming sectional doors comprising a plurality of panels articulated in pairs by means of said system, and wherein one of said edge sections (1) is provided, in its axial plane (X) with a circular bore (9) for placement of roller bearing axles at the sides.

17. An articulation system as in claim 16, and wherein each section (1, 3) is provided with structures (5, 6) adapted to have window panels clipped in.

18. An articulation system as in claim 16, and wherein each section (1, 3) is provided with a groove (7, 8) for insertion of the edge of a sheet (20) adapted to form the front face of the panel, and a flange (16, 17) for holding the edge of a sheet (18) adapted to form the rear face of the panel.

19. An articulation system as in claim 16, and wherein at least one of said edge sections (1) comprises, on one side, interlocking structures (10) for an inertial reinforcement (R).

20. Edge sections for connecting two panels, said edge sections being secured to said panels, and comprising:

channels (L1, L2) opening on the edge in the vicinity of the median plane of the panels and having shapes adapted to receive and retain portions of a flexible hinge, and rotational guide surfaces (SZx, SC; Sax, Sac, AL) arranged on either side of the median planes of the panels such that the guide surfaces of one edge section come into contact with the guide surfaces of the other edge section for guiding the pivoting of the panels about an axis of rotation passing through the flexible hinge.

* * * * *